US008806822B1

(12) United States Patent
Wang

(10) Patent No.: US 8,806,822 B1
(45) Date of Patent: Aug. 19, 2014

(54) MAT WITH PUZZLE FUNCTION

(71) Applicant: Wen Ping Wang, Taichung (TW)

(72) Inventor: Wen Ping Wang, Taichung (TW)

( * ) Notice: Subject to any disclaimer, the term of this patent is extended or adjusted under 35 U.S.C. 154(b) by 0 days.

(21) Appl. No.: 13/770,091

(22) Filed: Feb. 19, 2013

(51) Int. Cl.
*E04F 13/00* (2006.01)
*E04F 15/02* (2006.01)

(52) U.S. Cl.
CPC ..... *E04F 15/02005* (2013.01)
USPC ..... 52/311.2; 52/592.1; 273/153 R

(58) Field of Classification Search
USPC ..... 52/177, 311.2, 590.1, 590.3, 592.1; 273/153 R, 156, 157 R
See application file for complete search history.

(56) References Cited

U.S. PATENT DOCUMENTS 675,344 A * 5/1901 Bates ..... 52/311.2
708,470 A * 9/1902 Flood ..... 52/590.1
708,471 A * 9/1902 Flood ..... 52/513
1,822,608 A * 9/1931 Borden ..... 273/157 R
3,701,214 A * 10/1972 Sakamoto ..... 446/115
3,909,996 A * 10/1975 Ettlinger et al. ..... 52/177
4,018,025 A * 4/1977 Collette ..... 52/302.4
4,287,693 A * 9/1981 Collette ..... 52/177
4,497,858 A * 2/1985 Dupont et al. ..... 428/44
4,620,998 A * 11/1986 Lalvani ..... 428/33
5,052,158 A * 10/1991 D'Luzansky ..... 52/177
5,212,842 A * 5/1993 Glydon ..... 5/420
5,368,301 A * 11/1994 Mitchell ..... 273/157 R
5,791,114 A * 8/1998 Mandel ..... 52/591.3
6,416,054 B1 * 7/2002 Alfassi ..... 273/157 R
6,443,794 B2 * 9/2002 Oren et al. ..... 446/85
6,526,705 B1 * 3/2003 MacDonald ..... 52/177
6,640,513 B2 * 11/2003 Ku ..... 52/589.1
6,761,563 B1 * 7/2004 Lin ..... 434/169
D552,909 S * 10/2007 McGrath et al. ..... D6/582
7,470,166 B2 * 12/2008 Allen ..... 446/108
D603,640 S * 11/2009 Thrush ..... D6/582
7,797,890 B2 * 9/2010 Thrush et al. ..... 52/177
8,071,186 B1 * 12/2011 Quimby ..... 428/33
8,210,892 B2 * 7/2012 Thrush et al. ..... 446/108
8,266,857 B2 * 9/2012 David ..... 52/385
8,356,447 B2 * 1/2013 Lach ..... 52/177
8,534,023 B2 * 9/2013 Zhu et al. ..... 52/588.1
2006/0127647 A1 * 6/2006 Thrush ..... 428/172
2007/0199257 A1 * 8/2007 Thrush et al. ..... 52/180
2008/0263922 A1 * 10/2008 Ho et al. ..... 40/508
2013/0042567 A1 * 2/2013 Zhu et al. ..... 52/588.1

* cited by examiner

*Primary Examiner* — William Gilbert
*Assistant Examiner* — Gisele Ford
(74) *Attorney, Agent, or Firm* — Wang Law Firm, Inc.; Li K. Wang; Stephen Hsu

(57) ABSTRACT

A mat with puzzle function is a four-sided pad. Each side has a tooth part with a succession of teeth. At least two cutting lines divide the mat into four blocks, in such a way that each block has an assembling part with the complementary shape to connect with others. The block of each mat can engage with another block of the mat to form a puzzle mat set.

1 Claim, 8 Drawing Sheets

MAT WITH PUZZLE FUNCTION

BACKGROUND OF THE INVENTION

1. Field of Invention

The invention relates to the structure of mat on the floor and, in particular, to a mat with the puzzle function.

2. Related Art

Most of the foam mats lying on the floor are square pads, differing on their appearance or some internal shape variations. Therefore, the assembled mats are boring in general and lack changes.

Currently on the market there is another kind of mat with the puzzle function. Each side of the mat is formed with an assembling part to engage with another mat, therefore offering more assembly changes and fun. As shown in FIG. 8, the fabrication of such mats 91 with the puzzle function is formed by cutting a square pad 90. Each side of the mat 91 is cut to form an assembling part 92 to engage with another mat (not shown). Since the assembling part 92 on each side of the mat 91 has the shape of teeth, some part must become waste 93 during the process of cutting the square pad 90 into the mat 91. This inevitably leads to a higher manufacturing cost for the conventional mats 91.

Moreover, since each side of the conventional mat 91 has the tooth-shaped assembling part 92, there is a problem that the boundary of the entire set of mats on the floor cannot fully cover the floor near the walls and at the corners.

SUMMARY OF THE INVENTION

An objective of the invention is to provide a mat with the puzzle function to greatly reduce the production of waste during the production. This can effectively reduce the production cost.

Another objective of the invention is to provide a mat with the puzzle function so that the assembled mats have more varieties in the style.

To achieve the above-mentioned objectives, the disclosed mat with the puzzle function is a polygonal object with at least four sides. Each of the sides has a tooth part with a succession of teeth. At least two cutting lines divide the mat into four blocks. The two cutting lines form at the corresponding parts of the blocks assembling parts with complementary shapes for engagement. The blocks of the mat engage via the tooth parts with the corresponding blocks on another mat, thereby constituting a puzzle mat set.

Preferably, the two pairs of opposite sides of the puzzle mat set have assembling parts of the same shape, forming a symmetric puzzle mat set. The mat is divided into four blocks by two cutting lines extending to the two pairs of opposite sides and crossing at the center thereof. Any two blocks of the mat can form two diagonal parts of the puzzle mat set. Another mat has two cutting lines curving in the opposite way to the previous mat, so that the former is cut into four symmetric blocks. Any two blocks of the other mat can be assembled to form the other two diagonal parts of the puzzle mat set. Each block and the symmetric block engage with each other via the tooth parts thereof, thereby forming the puzzle mat set.

In an embodiment of the invention, the two pairs of opposite sides of the mat have assembling parts of the same shape. The mat is divided into four blocks by two cutting lines extending along the two diagonal directions and crossing in the shape of an X. Each block is half of the puzzle mat set, so that one block of the puzzle engages with another block thereof via the tooth parts, thereby forming the puzzle mat set.

In another embodiment, the two pairs of opposite sides of the puzzle mat set have assembling parts of the complementary shapes, forming a symmetric puzzle mat set. The mat is divided into four blocks by two cutting lines extending along the two diagonal directions and crossing in the shape of an X. Each block is one quarter of the puzzle mat set, so that the blocks of the mat engage with one another via the tooth parts, thereby forming the puzzle mat set.

In yet another embodiment, the two pairs of opposite sides of the puzzle mat set have assembling parts of the complementary shapes, forming a non-symmetric puzzle mat set. The mat is divided into four blocks by two cutting lines extending along the two diagonal directions and crossing in the shape of an X. Each block is half the puzzle mat set, so that one block of the mat engages with the other symmetric block thereof via the tooth parts, thereby forming the puzzle mat set.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Figure 1:
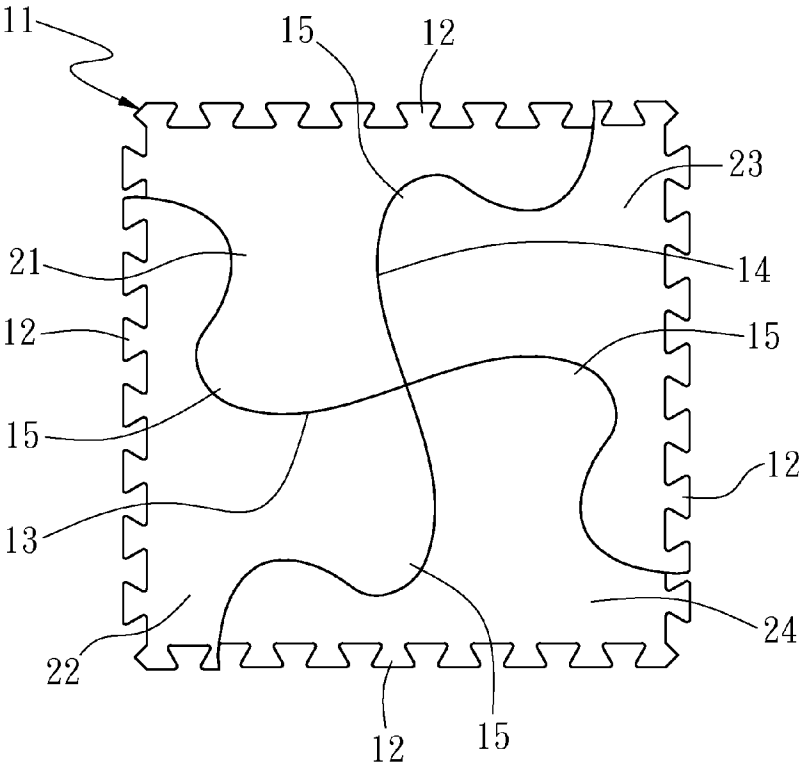
FIG. 1 is a schematic view of the structure of the first embodiment.

Please refer to FIG. 1 for a first embodiment of the disclosed mat with the puzzle function. The mat 11 is a square object with four sides, each of which has a tooth part 12 with a succession of teeth. The mat 11 has two cutting lines 13, 14 toward the two pairs of opposite sides and crossing at the center thereof, dividing the mat 11 into four blocks 21, 22, 23, 24. The two cutting lines 13, 14 curve in a regular way so that the corresponding parts of the blocks 21, 22, 23, 24 have assembling parts 15 with complementary shapes for engagement.

Figure 2:
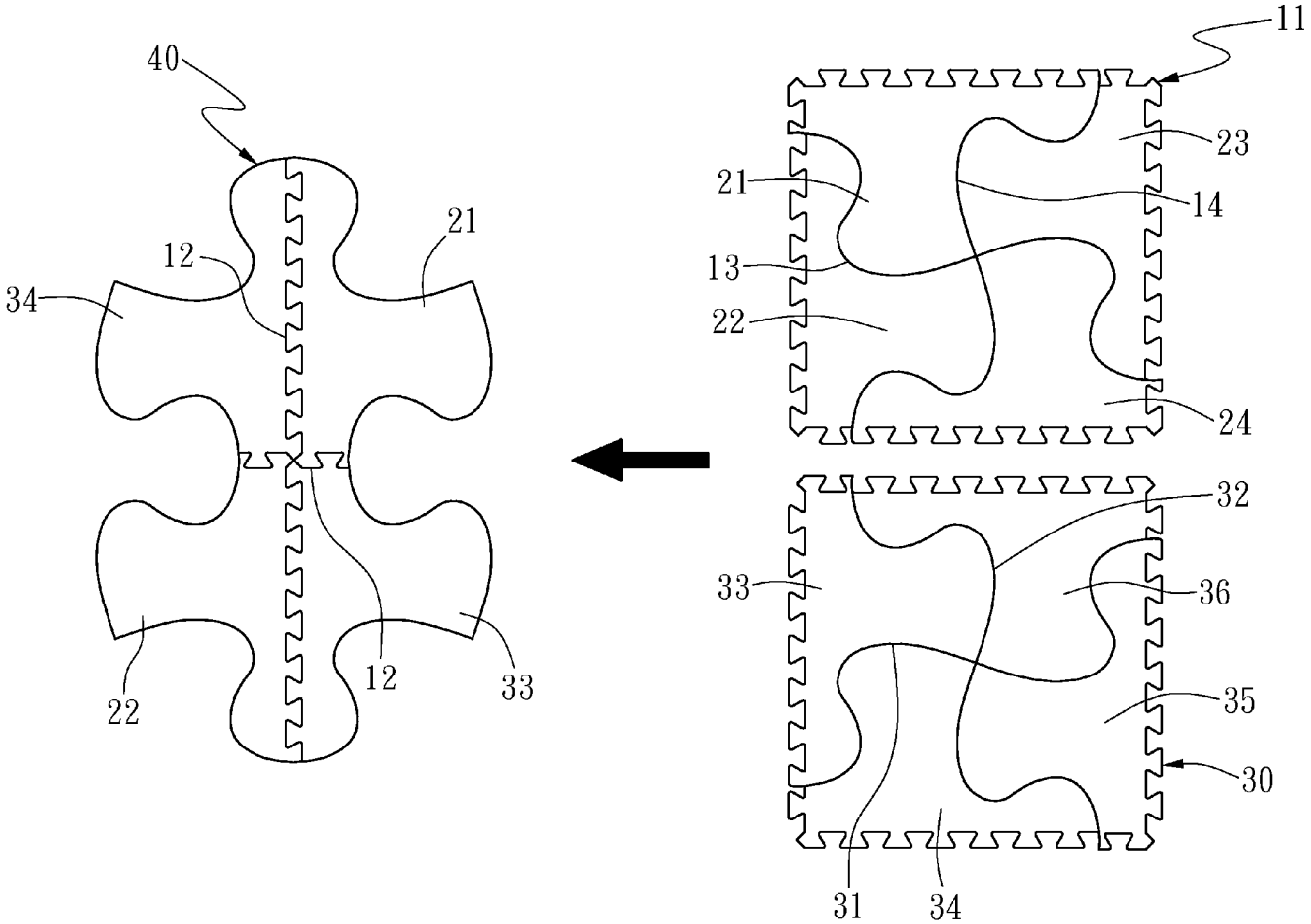
FIG. 2 is a schematic view of assembling the mats according to the first embodiment.

In the first embodiment, the two cutting lines 13, 14 divide the mat 11 into four blocks 21, 22, 23, 24 of the same shape. Therefore, any two blocks of the mat 11 can connect with two symmetric blocks of another mat, thereby constituting a symmetric puzzle mat set with two pairs of opposite sides having assembling parts of the same shape. As shown in FIG. 2, any two blocks 21, 22 of the mat 11 can form two diagonal parts of the symmetric puzzle mat set 40. Another mat 30 has two cutting lines 31, 32 curving in the opposite way to the mat 11, so that the mat 30 is divided into four reversed symmetric blocks 33, 34, 35, 36. Thus, any two blocks 33, 34 of the mat 30 can form the other two diagonal parts of the symmetric puzzle mat set 40. The blocks 21, 22 and the symmetric blocks 33, 34 engage with one another via the tooth parts 12 thereof to form the puzzle mat set 40. The remaining blocks 23, 24 and the symmetric blocks 35, 36 form another symmetric puzzle mat set (not shown).

Of course, one can use any two blocks 21, 22 of the puzzle may 11 to form two diagonal parts of the symmetric puzzle mat set 40, and flip the remaining two blocks 23, 24 over to form the other two diagonal parts thereof.

Since the mat 11 in this embodiment is cut into a right polygonal shape to form various constituting blocks of the puzzle mat set 40, there is no waste during the production. This effectively solves the problem in the prior art about wasting materials. Therefore, the invention can reduce the production cost.

Figure 3:
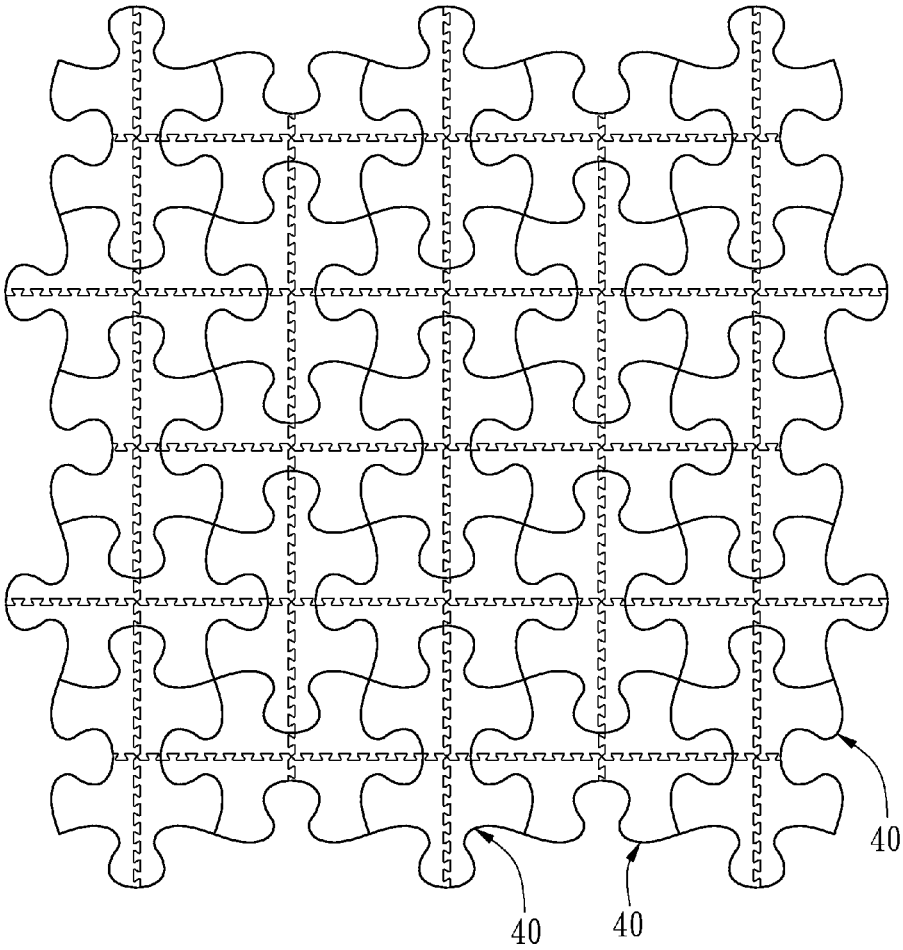
FIG. 3 is a schematic view of the first embodiment in use.
Figure 4:
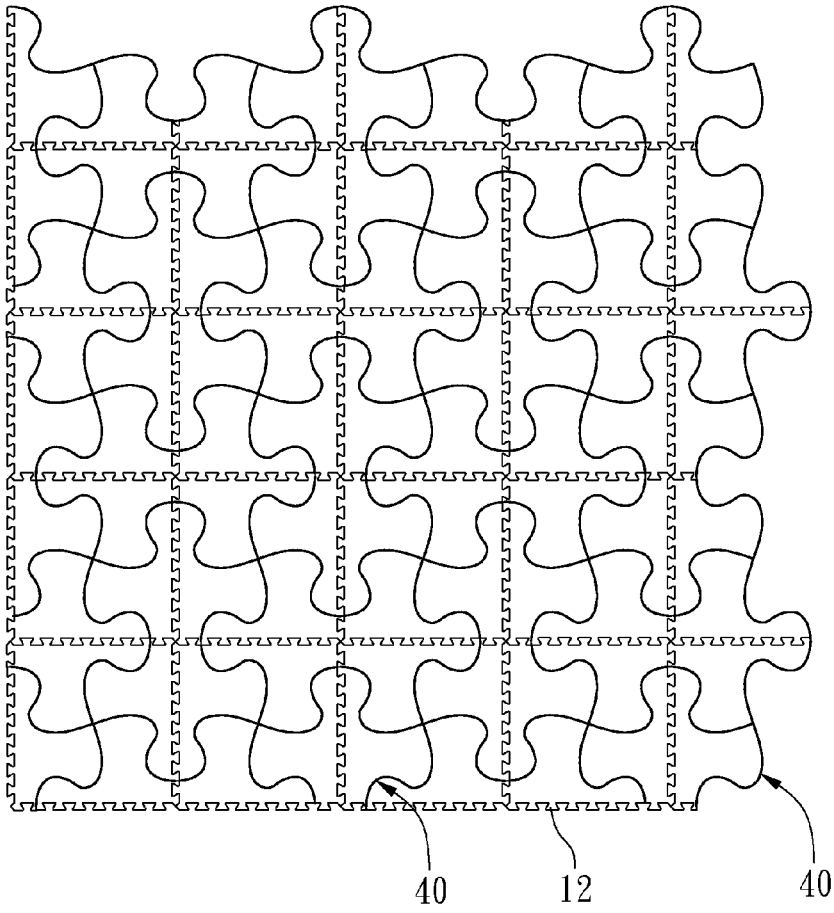
FIG. 4 is a schematic view of the first embodiment in use when some blocks are taken away.

The disclosed puzzle mat set 40 formed from the mats 11 can be combined with other puzzle mat sets to produce different shapes through appropriate combinations (such as shown in FIG. 3). In addition, the puzzle mat set 40 can have a variety of shapes through different combinations as well. As shown in FIG. 4, according to the user's needs, part of the puzzle mat set 40 formed from the mats 11 can be removed so that the boundary becomes smoother. This is particular useful and neat for the puzzle mat set 40 near the corners of a room.

Figure 5:
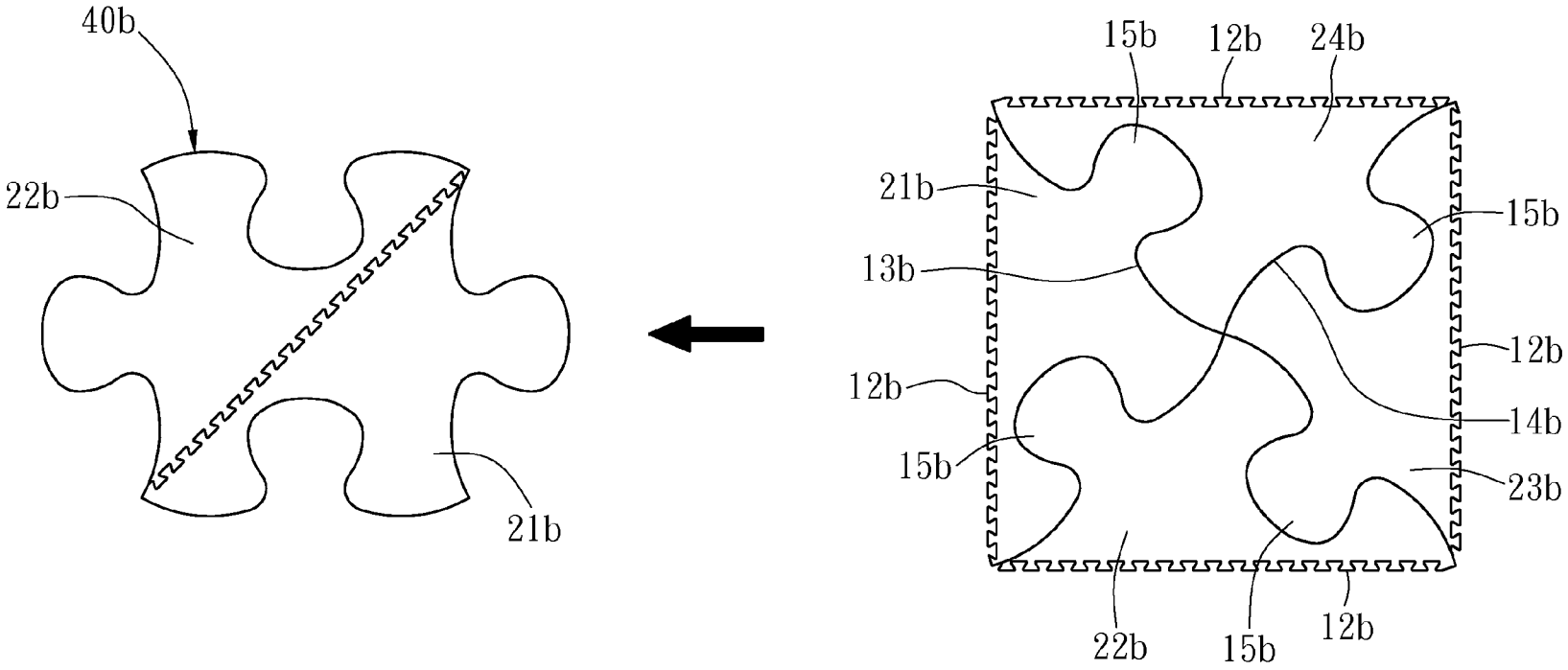
FIG. 5 is a schematic view of assembling the mats according to the second embodiment.

FIG. 5 shows a second embodiment of the disclosed mat with the puzzle function. The mat 11*b* is also a square object. Each side of the mat 11*b* has a tooth part 12*b* with a succession of teeth. The mat 11*b* has two cutting lines 13*b*, 14*b* along the diagonal directions and crossing at the center thereof in the shape of an X, dividing the mat 11*b* into four blocks 21*b*, 22*b*, 23*b*, 24*b*. The two cutting lines 13*b*, 14*b* are curved in a regular way so that the blocks 21*b*, 22*b*, 23*b*, 24*b* have assembling parts of complementary shapes for engagement.

In the second embodiment, the two cutting lines 13*b*, 14*b* divide the mat 11*b* into four block 21*b*, 22*b*, 23*b*, 24*b* identical in shape. Two of the blocks 21*b*, 22*b*, 23*b*, 24*b* form half of the symmetric puzzle set 40*b* with same assembling parts on the two pairs of opposite sides. Thus, one block 21*b* of the mat 11*b* and another block 22*b* of the mat 11*b* engage via the tooth parts 15*b* to form the symmetric puzzle mat set 40*b*. The remaining blocks 23*b*, 24*b* of the mat 11*b* form another symmetric puzzle mat set (not shown).

Figure 6:
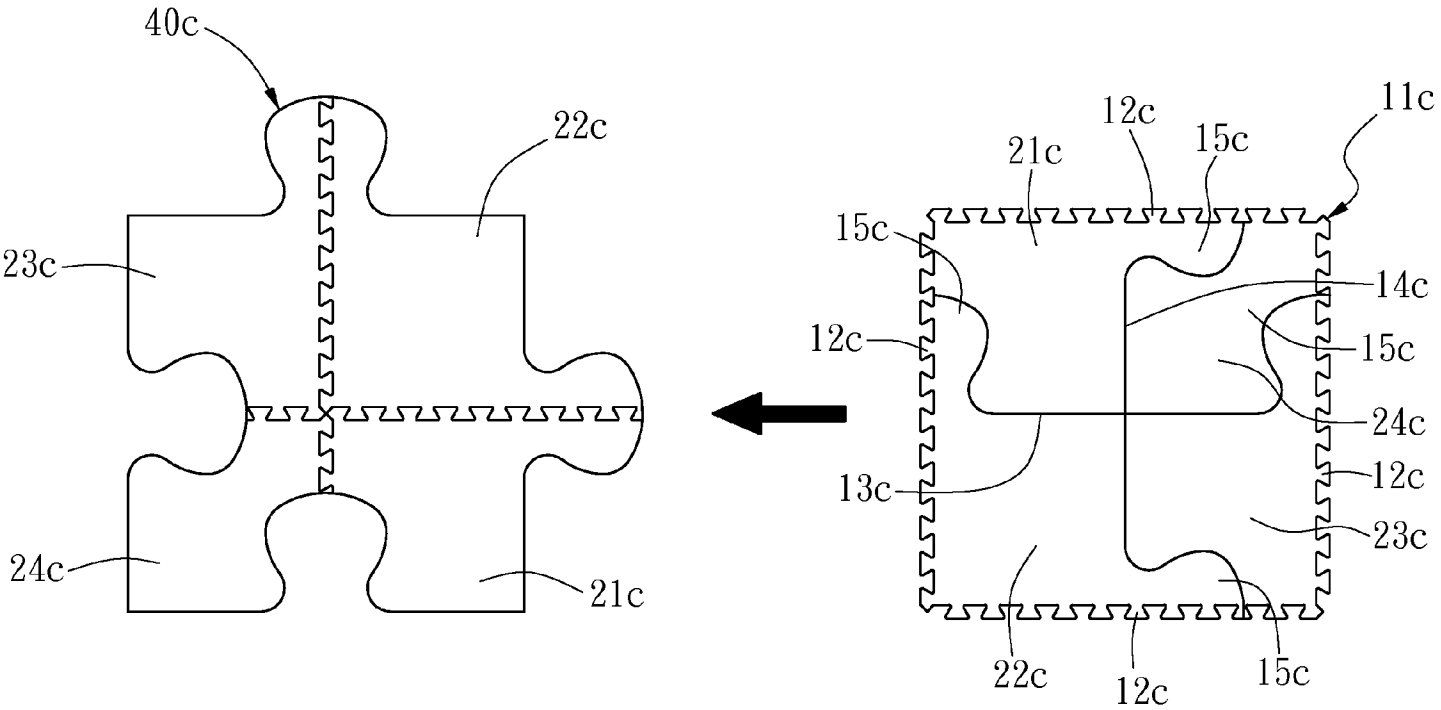
FIG. 6 is a schematic view of assembling the mats according to the third embodiment.

However, the disclosed mats are not limited to form symmetric puzzle mat sets. FIG. 6 shows a third embodiment in which the non-symmetric puzzle mat set 40*c* has complementary assembling parts on the two pairs of opposite sides. The mat 11*c* also has a square shape. Each side of the mat 11*c* has a tooth part 12*c* with a succession of teeth. The mat 11*c* has two cutting lines 13*c*, 14*c*, toward the two pairs of opposite sides and crossing at the center, thereby dividing the mat 11*c* into four blocks 21*c*, 22*c*, 23*c*, 24*c*. The cutting lines 13*c*, 14*c* are curved in a regular way so that corresponding parts of the blocks 21*c*, 22*c*, 23*c*, 24*c*, have assembling parts 15*c* with complementary shapes for engagement. Each of the blocks 21*c*, 22*c*, 23*c*, 24*c* becomes one quarter of a non-symmetric puzzle mat set. As a result, the blocks 21*c*, 22*c*, 23*c*, 24*c* of the mat 11*c* engage with one another to form the non-symmetric puzzle mat set 40*c*.

Figure 7:
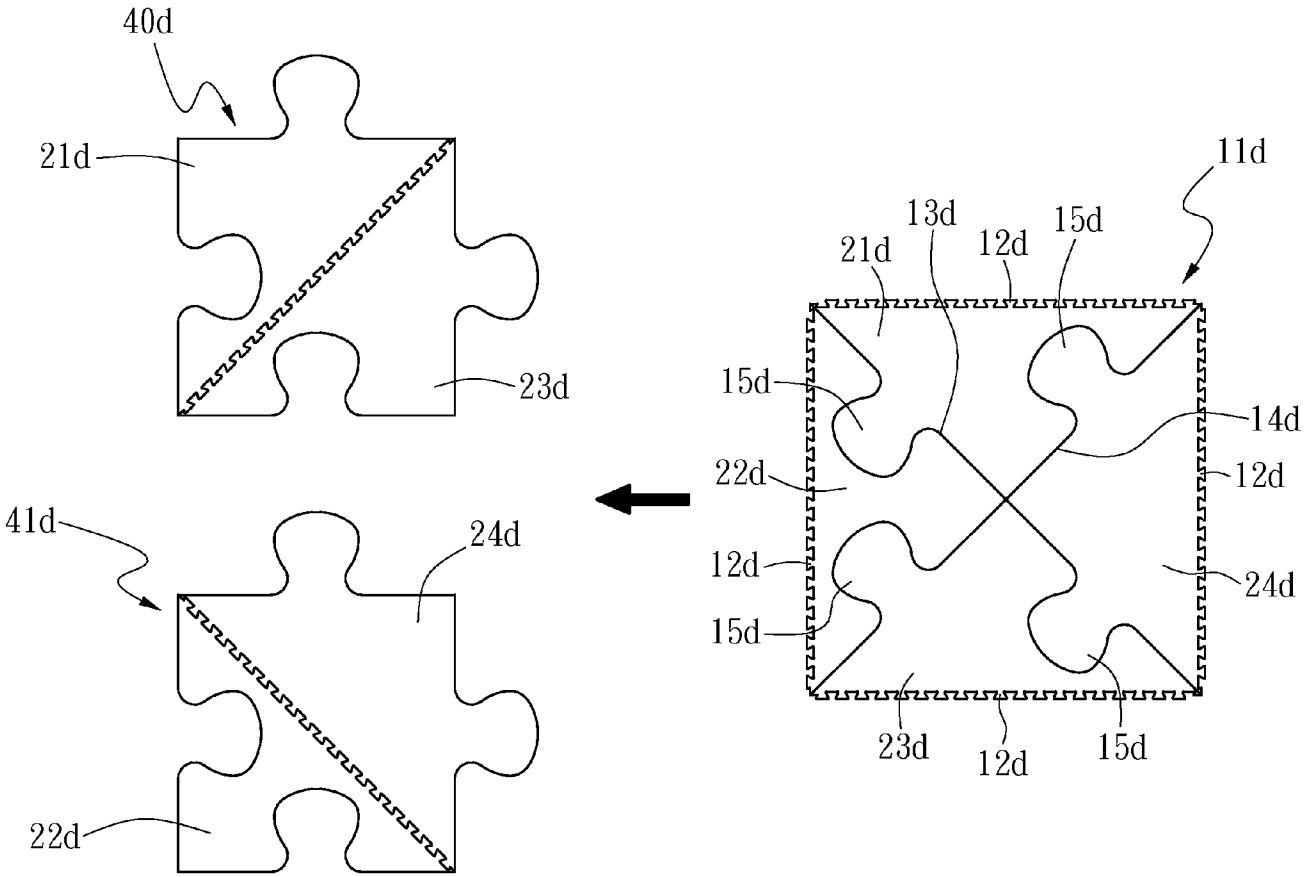
FIG. 7 is a schematic view of assembling the mats according to the fourth embodiment.
Figure 8:
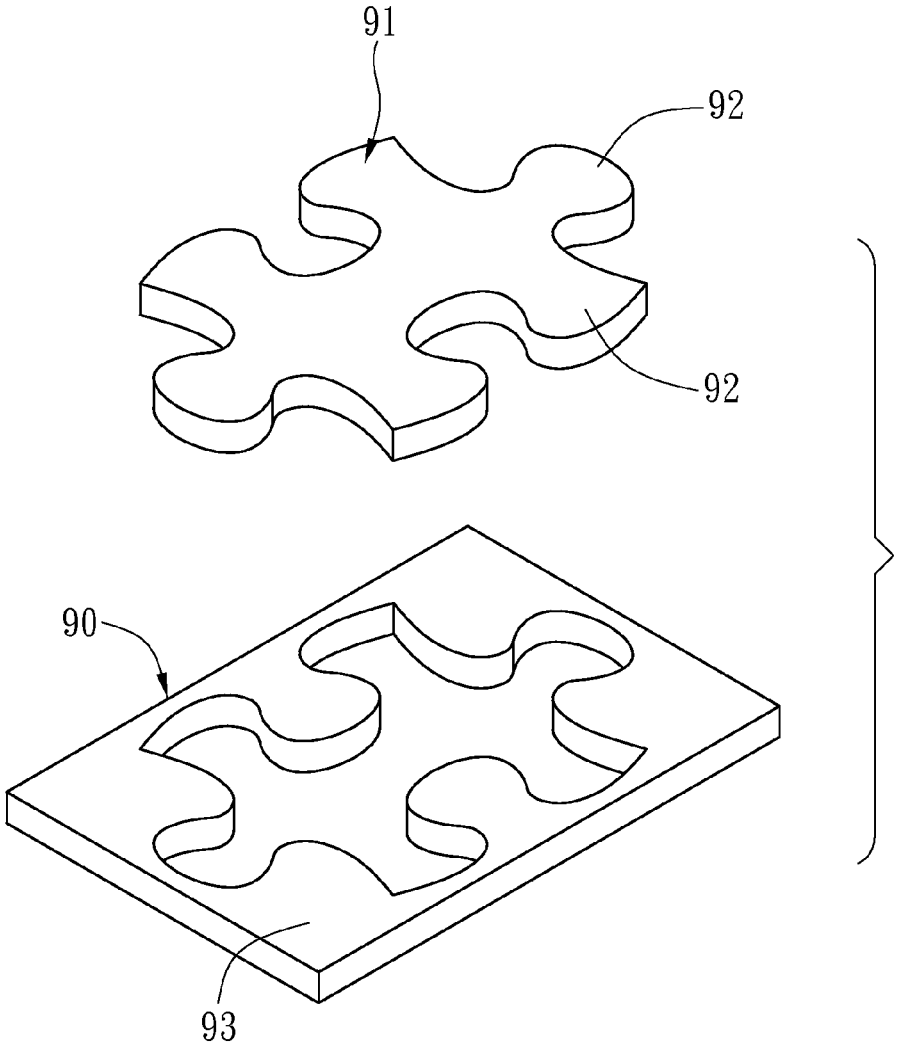
FIG. 8 PRIOR ART
FIG. 8 is a schematic view of making a conventional mat.

Please refer to FIG. 7, which shows a fourth embodiment of the invention on a non-symmetric puzzle mat set. Likewise, the mat 11*d* is a square object. Each side of the mat 11*d* has a tooth part 12*d* with a succession of teeth. The mat 11*d* has two cutting lines 13*d*, 14*d* along the two diagonal directions and crossing in the shape of an X, thereby dividing the mat 11*d* into four blocks 21*d*, 22*d*, 23*d*, 24*d*. The two cutting lines 13*d*, 14*d* are curved in a regular way such that corresponding parts of the blocks 21*d*, 22*d*, 23*d*, 24*d* have assembling parts 15*d* with complementary shapes for engagement. Each of the blocks 21*d*, 22*d*, 23*d*, 24*d* forms one half of a non-symmetric puzzle mat set 40*d*. Therefore, one block 21*d* of the mat 11*d* engages with another symmetric block 23*d* of the mat 11*d* via the tooth parts, thereby forming the non-symmetric puzzle mat set 40*d*. The remaining blocks 22*d*, 24*d* of the mat 11*d* can be combined to form another non-symmetric puzzle mat set 41*d*.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A mat comprising:

at least two pairs of opposing sides forming a perimeter for a polygonal object, each side having a tooth part comprising a succession of teeth, and at least two curved cutting lines dividing the mat into four blocks in such a way that each of the four blocks has a curved assembling part for engagement with an adjacent one of the four blocks, wherein each of the four blocks of the mat is configured to be engaged with an adjacent mat via the tooth part to form a puzzle mat set.

* * * * *